US006322945B1

(12) United States Patent
Nakabayashi et al.

(10) Patent No.: US 6,322,945 B1
(45) Date of Patent: Nov. 27, 2001

(54) PROCESS FOR PRODUCING AN ELECTROPHOTOGRAPHIC PHOTORECEPTOR AND THE ELECTROPHOTOGRAPHIC PRODUCED BY THAT PROCESS

(75) Inventors: Wataru Nakabayashi; Kazuya Hongo; Koichi Yasaku; Kazuaki Aoki; Masaaki Suwabe; Kiyoshi Hashimoto; Satoru Inakage, all of Kanagawa (JP)

(73) Assignee: Fuji Xerox Co., LTD, Tokyo (JP)

( * ) Notice: Subject to any disclaimer, the term of this patent is extended or adjusted under 35 U.S.C. 154(b) by 0 days.

(21) Appl. No.: 08/479,862

(22) Filed: Jun. 7, 1995

Related U.S. Application Data

(63) Continuation of application No. 08/126,584, filed on Sep. 27, 1993, now abandoned.

(30) Foreign Application Priority Data

Sep. 28, 1992 (JP) ..... 4-281034

(51) Int. Cl.[7] ..... G03G 5/04

(52) U.S. Cl. ..... 430/133; 430/127

(58) Field of Search ..... 430/127, 133, 430/128

(56) References Cited

U.S. PATENT DOCUMENTS

| | | | | |
|---|---|---|---|---|
| 2,657,152 | * | 10/1953 | Mengali et al. | 430/133 |
| 3,956,524 | * | 5/1976 | Weigl | 427/40 |
| 4,492,745 | * | 1/1985 | Mimura et al. | 430/127 |
| 4,713,311 | * | 12/1987 | Senske et al. | 430/127 |
| 5,238,607 | * | 8/1993 | Herron et al. | 252/518 |

FOREIGN PATENT DOCUMENTS 62-266143 11/1987 (JP) .

OTHER PUBLICATIONS

Hackh's Chemical Dictionary, Ed. J. Grant 4th Edition (1969) pp 623 & 624.*

Cotton, F. A. and G. Wilkinson, *Advanced Inorganic Chemistry*, Third Edition NY, Interscience Publishers, 1972, p. 427.*

Weast, R. C. Ed, *CRC Handbook of Chemistry & Physics*, 52 Edition, OH, The Chemical Rubber Co., 1971, pp D–171, D–175, D–176, 1971.*

Kirk–Othmer, *Encyclopedia of Chemical Technology*, Third Edition, vol 10, NY, John Wiley & Sons, 1980, pp 250–252, 1980.*

"Gas and Humidity Sensors Based on Organic Active Thin Films", C. Hamann et al, Sensors and Actuators. B1:142–147 (1980) Feb.

Denki Kagaku, 46, No. 11: 597–603 (1978) Nov.

Search Report Taken From a Book Entitled "Air Pollution Caused By Photochemical Reaction", Lectures presented Mar. 11–12, 1972 by Japan Society of Air Pollution and Japan Public Health Foundation, pp 223–231.

* cited by examiner

*Primary Examiner*—Janis L. Dote
(74) *Attorney, Agent, or Firm*—Finnegan, Henderson, Farabow, Garrett & Dunner, L.L.P.

(57) ABSTRACT

A process for producing an electrophotographic photoreceptor including a step of coating a light-sensitive layer on an electroconductive base, a step of removing part or all of oxidants present from an air atmosphere by an oxidants removing unit, a step of dealing with a coating solution for forming the light-sensitive layer in the air atmosphere from which concentration of oxidants is suppressed by the step of removing part or all of oxidants present, and a step of suppressing variation in the concentration of oxidants in the air atmosphere, wherein the step of dealing with the coating solution for the light-sensitive layer includes at least one of the steps of preparing the coating solution for forming the light-sensitive layer, applying the light-sensitive layer and drying an applied coating.

13 Claims, 2 Drawing Sheets

PROCESS FOR PRODUCING AN ELECTROPHOTOGRAPHIC PHOTORECEPTOR AND THE ELECTROPHOTOGRAPHIC PRODUCED BY THAT PROCESS

This application is a continuation of application Ser. No. 08/126,584, filed Sep. 27, 1993, now abandoned.

BACKGROUND OF THE INVENTION

The present invention relates to a process for producing an electrophotographic photoreceptor that has a light-sensitive layer coated on an electroconductive base. More particularly, the invention relates to a process by which electrophotographic photoreceptors of high quality can be manufactured for a long term without experiencing variations in their characteristics. The invention also relates to the electrophotographic photoreceptor that is produced by that process.

Various inorganic and organic photoconductive materials are known to be useful in electrophotographic photoreceptors. Organic photoconductive materials as applied to electrophotography have several advantages such as high film transparency, good film forming property, flexibility and low cost.

With a view to improving the sensitivity and durability of photoreceptors that use organic photo-conductive materials, a double-layer type has been proposed that has the light-sensitive layer divided functionally into a charge generation layer and a charge transport layer. In a typical case, the charge generation layer is formed by first preparing a coating solution that has a charge generation material dissolved in a suitable solvent together with a binder resin and any necessary additives, then applying the solution to a conductive base and finally drying the applied coat. Similarly, the charge transport layer is formed by first preparing a coating solution that has a charge transport material dissolved in a suitable solvent together with a binder resin and any necessary additives, then applying the solution to the already formed charge generation layer, and finally drying the applied coat. If necessary for improving the adhesion of the applied coat and the charge retaining ability, a subbing layer may sometimes be applied and dried between the base and the light-sensitive layer. The respective coating solutions used in this particular case are typically prepared in separate steps and supplied individually to the application and drying steps.

The subbing layer, the charge generation and the charge transport layer can be applied by various coating methods including blade coating, wire bar coating, spray coating, dip coating, bead coating, curtain coating, air knife coating, rod coating, applicator coating, web coating and gravure coating. The applied coatings of subbing layer, charge generation layer and charge transport layer can be dried by various known techniques including the blasting of hot air as produced by heating atmospheric air and exposure to electromagnetic waves such as infrared rays and electron beams.

The above-stated process for the manufacture of electrophotographic photoreceptors has involved the problem that variations in the quality of coating solutions occur in the step of their preparation to affect the characteristics of the photoreceptor as the final product. In other words, preparing coating solutions from the same materials by the same processing method will in no way assure consistency in the quality of the coating solutions and this has made it difficult to manufacture electrophotographic photoreceptors having consistent characteristics.

Furthermore, using production equipment that employed devices for applying the coating solutions and drying the applied coatings in accordance with the steps described above, the present inventors produced a lot of electrophotographic photoreceptors on a continuous basis for a prolonged term and conducted close studies on the characteristics of those photoreceptors. As it turned out, even in a one-day production, some photoreceptors had high photosensitivity while others had low sensitivity. When the production continued for several days, variations occurred on different days of coating application. Significant variations are also frequent in a one-year production. These variations affected the performance of the electrophotographic photoreceptors as the final product, making it impossible to manufacture photoreceptors having consistent characteristics. Thus, the adverse effects of the variations on the quality of the final product have been a great concern to the manufacturers of photoreceptors.

The present invention has been accomplished under these circumstances and has as an object providing a process by which electrophotographic photoreceptors having consistent characteristics can be manufactured continuously for a long period of time.

SUMMARY OF THE INVENTION

To attain this object, the present inventors conducted intensive studies and have finally found that the variations in the characteristics of electrophotographic photoreceptors that occur within a day, between days and even between seasons when those photoreceptors are manufactured for a prolonged continuous period are due to the entrance of very small amounts of aerial impurity gases into the solution preparing compartments or the coating compartments or the drying units. Further analyses have shown that while several kinds of pollutants exist in very small quantities in atmospheric air, the changes in the concentrations of photochemical oxidants are very closely related to the variations in the characteristics of electrophotographic photoreceptors.

The term "photochemical oxidants" as used herein means ozone, peroxyacetyl nitrate (PAN) and any other oxidative substances that are formed by photochemical reactions which, excepting nitrogen dioxide, will release iodine from a neutral solution of potassium iodide; nearly 90% of these photochemical oxidants are occupied by ozone. The concentration of aerial ozone varies complexly due not only to the photochemical reactions but also to the fall of stratospherical ozone on the ground and the phenomenon of discharges in air.

The present inventors found that by suppressing the variation in the concentration of oxidants in ambient air during the process of preparing coating solutions or applying them or drying the applied coatings and by preferably holding the maximum concentration of oxidants to no more than specified values, electrophotographic photoreceptors of consistent characteristics could be manufactured even on an industrial scale involving prolonged continuous production. The present invention has been accomplished on the basis of this finding.

In the general aspect to the present invention, a process for producing an electrophotographic photoreceptor includes a step of coating a light-sensitive layer on an electroconductive base, a step of removing part or all of oxidants present from an air atmosphere by an oxidants removing unit, a step of dealing with a coating solution for forming the light-sensitive layer in the air atmosphere from which concentration of oxidants is suppressed by the step of removing part or all of oxidants present, and a step of suppressing variation in the concentration of oxidants in the air atmosphere, wherein the step of dealing with the coating solution for the light-sensitive layer includes at least one of the steps of preparing the coating solution for forming the light-sensitive layer, applying the light-sensitive layer and drying an applied coating.

Preferably, the maximum concentration of oxidants in the air atmosphere is suppressed to 80 ppb and below when preparing the coating solution, or suppressed to 50 ppb and below when applying or drying the light-sensitive layer, or both.

The present invention has been described below in detail.

When preparing coating solutions in a step of the process for producing an electrophotographic photoreceptor, the starting materials for each coating solution are taken out of their storage sites, weighted, dispersed or dissolved and subjected to any other necessary processing operations. If oxidants enter the compartments where the coating solutions are being prepared, the oxidants contact the respective coating solutions and will either react with their components or will be adsorbed on the coating solutions, thereby affecting adversely the characteristics of the coating solutions being prepared.

The base to which the coating solutions have been applied by coating units is air dried and then dried by heating with film drying units. In this case, too, oxidants will enter the coating compartments and the drying units; if this occurs, the oxidants contact the coatings on the photoreceptor not only in the coating step but also in the air drying and thermal drying steps and they will be either adsorbed on the coatings or will react with the components of the latter, thereby causing subtle effects on the characteristics of the photoreceptor in the process of production.

Needless to say, if the concentration of existing oxidants varies, the effects on the coating solutions and the coating applied will vary accordingly, thereby introducing inconsistency in the characteristics of the electrophotographic photoreceptors finally produced.

Under these circumstances, the process of the present invention is adapted in such a way as to suppress the variations that occur in the concentration of oxidants in the compartment for preparing a coating solution for forming a light-sensitive layer, or the compartment containing a coating unit for applying the light-sensitive layer on a conductive base, or the drying unit for drying the applied coating. To implement this process, the air conditioning equipment connected to the solution preparing compartment or the coating compartment or the drying unit is provided with an oxidant removing unit in either one of the fluid passageways extending from the atmospheric air intake to the associated inlets for supplying air to the respective compartments or unit. It is desired that the concentration of oxidants be maintained at all times at 80 ppb or below in the solution preparing compartment and at 50 ppb or below in the coating compartment or drying unit, whereby the increase in the concentration of oxidants is minimized. As a consequence, it is insured that electrophotographic photoreceptors having good characteristics are manufactured in a consistent way.

The concentrations of oxidants in atmospheric air can drop significantly within a day or between seasons. To deal with this problem, the air conditioning equipment connected to the solution preparing compartment or the coating compartment or the drying unit may be provided with an oxidant generator and an associate control system, and a sensor for measuring the concentration of oxidants in the solution preparing compartment or the coating compartment or the drying unit, and the oxidants are first mixed in the air to be aspirated and the resulting oxides are then removed or, alternatively, the same oxides are mixed in oxidant-free air, so as to insure that the variations in the concentration of oxidants that occur during the production of electrophotographic photoreceptors will at all times be suppressed to 50 ppb and below even if the manufacture continues for a prolonged time.

DETAIL DESCRIPTION OF THE PREFERRED EMBODIMENTS

The present invention is described below in greater detail with reference to FIGS. 1 to 4.

Figure 1:
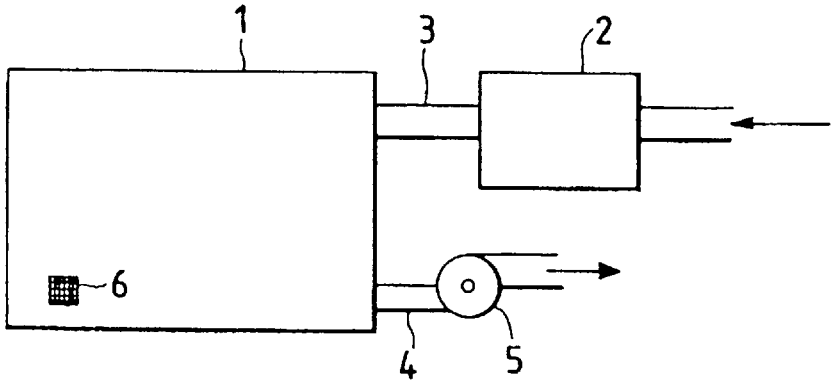
FIG. 1 shows the general layout of the compartment in which coating solutions for forming a light-sensitive layer are to be prepared in accordance with the present invention.

FIG. 1 shows the general layout of the compartment in which coating solutions for a forming light-sensitive layer are to be prepared in accordance with the present invention. As shown, the compartment indicated by 1 is supplied with conditioned air via an air conditioning control unit 2 through an air duct 3, and coating solutions for forming a charge generation layer and a charge transport layer are prepared in that compartment. The air in the compartment 1 is discharged by a blower 5 through an exhaust duct 4. Shown by 6 is a sensor which measures the concentration of oxidants in the compartment 1 and controls the control unit 2 in such a way that the measured concentration will lie either at predetermined values or within predetermined ranges.

Figure 2:
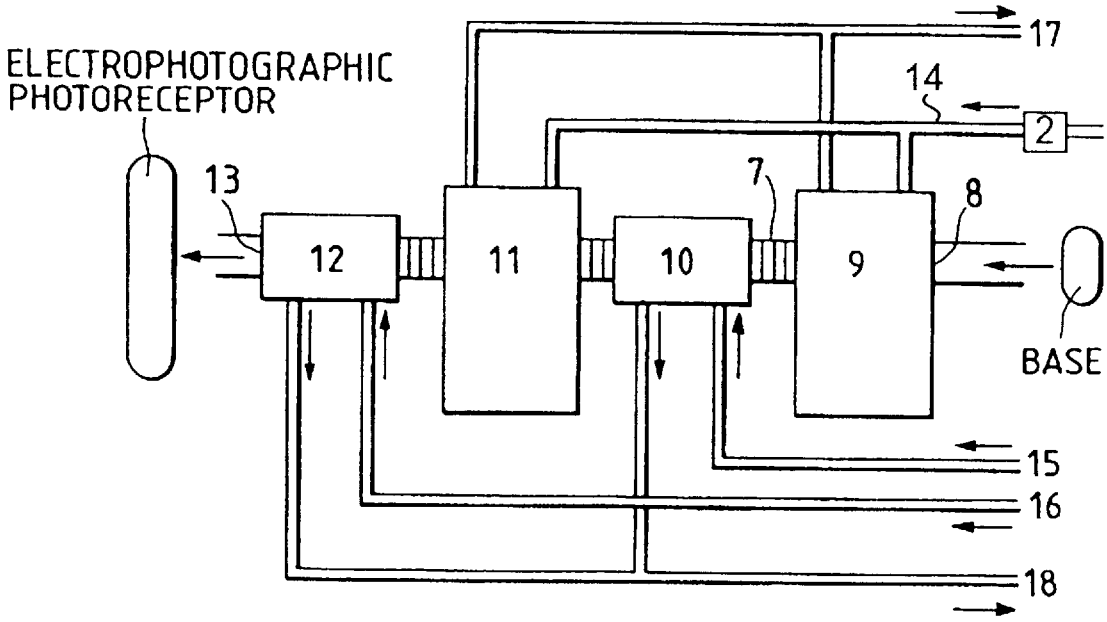
FIG. 2 shows a general scheme for implementing the process of the present invention for producing an electrophotographic photoreceptor.

FIG. 2 shows a general scheme for implementing the process of the present invention for producing an electrophotographic photoreceptor. As shown, a conductive base being transported on a conveyor 7 passes through an entrance 8 to enter a compartment 9 for coating a charge generation layer and an associated drying unit 10 in that order, whereby a charge generation layer is formed. Thereafter, the base now having the charge generation layer passes through a compartment 11 for coating a charge transfer layer and an associated drying unit 12 in that order, whereby a charge transport layer is formed on the charge generation layer. Then, the photoreceptor having the charge generation and transport layers formed on the base is delivered through an exit 13.

The coating compartments 9 and 11 are supplied with conditioned air via the control unit 2 through an air duct 14. The drying unit 10 is supplied with heated conditioned air through a charge generation layer drying air duct 15, whereas the drying unit 12 is supplied with heated conditioned air through a charge transport layer drying air duct 16. The air in the coating compartments 9 and 11 is discharged through an exhaust duct 17 whereas the air in the drying units 10 and 12 is discharged through an exhaust duct 18.

Figure 3:
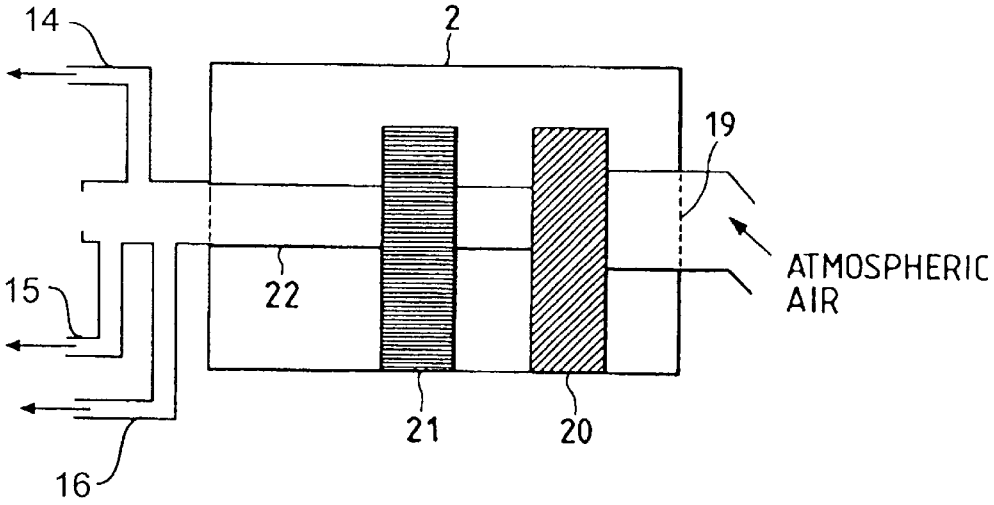
FIG. 3 shows the air conditioning control unit provided additionally in the equipment for producing an electrophotographic photoreceptor in accordance with the present invention.

The conditioned air is the same as atmospheric air except that it has been freed of oxidants and adjusted for temperature and moisture by activating the control unit 2 which is shown schematically in FIG. 3. The air conditioning control unit 2 is such that part or all of the ozone present in the atmospheric air aspirated through an air intake 19 is removed by an ozone removing unit 20 whereas the temperature and moisture of said air are controlled by air conditioner 21. To control the concentration of oxidants so that it lies either at predetermined values or within predetermined ranges, a sensor, such as sensor 6 shown in the general schematic of FIG. 1, is employed. The sensor may also maintain the temperature and moisture of the ozone-free air at predetermined values. Conventional sensors may be used. If necessary, the control unit 2 may additionally be equipped with an oxidant generator which, as mentioned above, is activated to minimize the variations that occur in the concentration of sulfur oxides.

The thus conditioned air is permitted to flow through the air ducts 14, 15 and 16 that are each connected to the air pipe 22. The air flowing through the ducts 15 and 16 is used to dry the charge generation and transport layers and, hence, it is preliminarily heated. The air is then introduced into the coating compartments 9 and 11, as well as into the drying units 10 and 12. The ozone removing unit 20 shown in FIG. 3 may be positioned upstream of the air conditioner 21 with respect to the flow of atmospheric air stream so that the air is freed of ozone after its temperature and moisture have been adjusted to predetermined conditions.

The ozone removing unit 20 may adopt various techniques such as thermal decomposition, cleaning with chemicals, adsorption by activated carbon, and catalytic adsorption. Considering the equipment size, ozone removing ability, running cost, ease of maintenance and safety, the use of ozone removing filters which depend on catalytic adsorption is the best.

The air conditioning control unit 2 shown in FIG. 3 incorporates the ozone removing unit 20 to remove aerial ozone. If desired, the control unit 20 may additionally incorporate a unit for removing non-ozone oxidants such as PAN and the mist of sulfuric anhydride. Not only ozone but also other oxidants can be removed by causing the air to pass through filters that are packed with a reducing material and, optionally, a basic material, or by bringing the air into contact with a solution having these materials dissolved therein.

Figure 4:
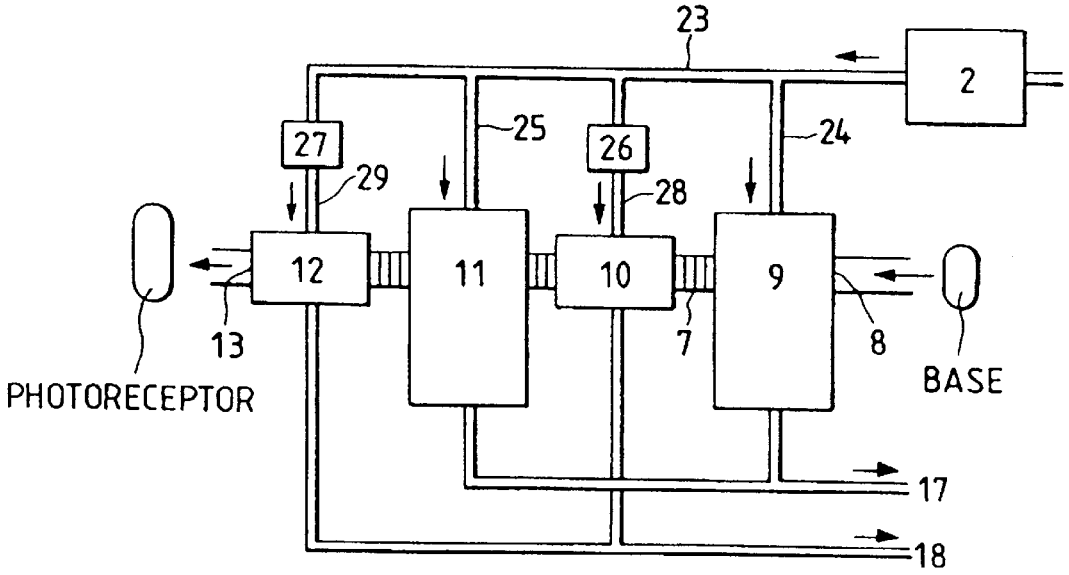
FIG. 4 shows another general scheme for implementing the process of the present invention for producing an electrophotographic photoreceptor.

FIG. 4 shows another general scheme for implementing the process of the present invention for producing an electrophotographic photoreceptor. In this scheme, atmospheric air is collectively conditioned by the air conditioning control unit 2. The thus conditioned air passes through a main air duct 23, then through sub-air ducts 24 and 25 to be directly introduced into the coating compartments 9 and 11, respectively; further, the air passing through the main duct 23 is heated by heating units 26 and 27 and thence introduced into the drying units 10 and 12 via sub-air ducts 28 and 29, respectively.

The production scheme shown in FIG. 4 has the advantage that only one air conditioning control unit 2 need be employed. As a further advantage, only one heating unit need be used if the temperature of the drying air to be introduced into the drying unit 10 is set to be equal to that of the drying air to be introduced into the drying unit 12. Even if the temperatures of the two streams of drying air are different, part of the conditioned air bypassing the heating unit may be mixed with heated drying air to make a mixture that has an appropriate temperature, which is then introduced into the drying unit that is set for the lower drying temperature.

Using the production equipment described above, the variation in the concentration of oxidants within the solution preparing compartment 1, the coating compartments 9 and 11, or in the drying units 10 and 12 can be controlled so that they are always held at 50 ppb and below. If the variation in the concentration of oxidants within the compartments exceeds 50 ppb, the oxidants will cause adverse effects on the photoreceptor being produced, resulting in the manufacture of photoreceptors that suffer from variations or inconsistency in characteristics. If the variation in the concentration of oxidants is 50 ppb and below, the oxidants will hardly affect the characteristics of the photoreceptor being prepared and the manufacture of photoreceptors having consistent characteristics can be continued for a prolonged period. The range of permissible variations in the concentration of oxidants is not the sole parameter that can be controlled in accordance with the present invention; if desired, the maximum concentration of oxidants within the solution preparing compartment 1 may be controlled not to exceed 80 ppb while, at the same time, the maximum concentration of oxidants within the coating compartments 9 and 11 or within the drying units 10 and 12 may be controlled not to exceed 50 ppb. In this case, too, photoreceptors having consistent characteristics can be produced.

For the purpose of producing photoreceptors having consistent characteristics, it is more effective to control the concentration of oxidants in ambient air in accordance with the present invention (i.e., reducing the oxidant concentration to the predetermined value and below, or suppressing the variation in the oxidant concentration to lie within the smallest possible range) during the application of coating solutions or drying the applied coatings rather than during the preparation of the coating solutions.

The coating equipment to be used within the coating compartments 9 and 11 may adopt the various coating techniques already listed hereinabove and the dip coating process can advantageously be used for performing coating on bases in a drum shape.

The process of the present invention may be applied to the manufacture single-layer photoreceptors but the process will prove more effective if it is applied to the manufacture of double-layer photoreceptors. The process of the present invention is also effective in producing photoreceptors of such a type that either one of a charge generation layer and a charge transport layer is formed by evaporation whereas the other layer is formed by a coating technique.

The electrophotographic photoreceptor of the present invention may have a subbing layer between the conductive base and the charge generation layer. The equipment for producing this type of photoreceptor has a subbing layer coating compartment and its drying unit provided between the base entrance 8 and the charge generation layer coating compartment 9. The subbing layer coating compartment has the same construction as the coating compartment 9 whereas its drying unit has the same construction as the charge generation layer drying unit 10.

EXAMPLES

The following examples are provided for the purpose of further illustrating the present invention. The term "parts" as used in the following examples and comparative examples means parts by weight.

Example 1

Coating solutions for forming a light-sensitive layer are prepared by the following method within the solution preparing compartment 1 shown in FIG. 1. The ozone removing unit 20 shown in FIG. 3 is composed of ozone removing filters (SCH-813, the trade name of Sakai Chemical Industry Co., Ltd.).

Three parts of polyvinyl butyral (EL-lec BX-1, the trade name of Sekisui Chemical Co., Ltd.) are dissolved in 100 parts of methyl ethyl ketone. To the resulting solution, 3 parts of x-type metal-free phthalocyanine is added and dispersed with a sand mill for 10 h. Thereafter, the dispersion is diluted with methyl ethyl ketone to prepare a coating solution for forming a charge generation layer that had a solids content of 4.0 wt %.

To prepare a coating solution for forming a charge transport layer, 4 parts of a charge transport material (N,N'-diphenyl-N,N'-bis(m-tolyl)benzidine) is dissolved in 40 parts of monochlorobenzene together with 6 parts of a polycarbonate Z resin.

During the preparation of coating solutions, the concentrations of oxidants in atmospheric air and the solution preparing compartment 1 are monitored with an oxidant level detecting monitor 6 (Atmospheric Aerial Oxidant Meter GXH-73M, the trade name of Denki Kagaku Keiki Co., Ltd.). As it turned out, the concentration of oxidants in atmospheric air varied over the range 15 to 100 ppb but the variation in the oxidant concentration within the solution preparing compartment 1 is suppressed to values in the range 0 to 15 ppb.

Using the thus prepared coating solutions, electrophotographic photoreceptors are produced by the following method in the production equipment shown in FIG. 2. The charge generation layer coating compartment 9 and the charge transport layer coating compartment 11 are each equipped with a dip coating device. The variations in the concentrations of oxidants within the coating compartments 9 and 11, as well as in the drying units 10 and 12 are suppressed by using conditioned air that had been controlled with the air conditioning control unit 2 shown in FIG. 3. Here again the ozone removing unit 20 is composed of ozone removing filters (SCH-813, the trade name of Sakai Chemical Industry Co., Ltd.).

Bases (aluminum pipes of 40 $mm^{\Phi}$×219 $mm^{L}$) are coated with the coating solution for forming a charge generation layer within the coating compartment 9; the applied coating is dried in the drying unit 10 by heating for 10 min with the conditioned air that had been heated to 100° C.; as a result, a charge generation layer is formed in a thickness of 0.3 $\mu$m. Subsequently, the charge generation layer is coated with the coating solution for forming a charge transport layer within the coating compartment 11; the applied coating is dried in the drying unit 12 by heating for 60 min with the conditioned air that had been heated to 130° C.; as a result, a charge transport layer is formed in a thickness of 18 $\mu$m.

The production of photoreceptors by the coating and drying steps described above is continued for 24 h, throughout which period the concentrations of oxidants in the coating compartments 9 and 11, as well as in the drying units 10 and 12 are monitored with a meter that measured the absorbance with the aid of a neutral potassium iodide absorbing solution. As it turned out, the concentration of oxidants in atmospheric air varied over the range 0 to 100 ppb but the variations in the oxidant concentrations within the coating compartments 9 and 11, as well as in the drying units 10 and 12 wee suppressed to values in the range 0 to 20 ppb.

A total of 20 photoreceptor drums are sampled randomly from the photoreceptors produced in the manner described above.

Example 2

Coating solutions for forming a charge generation layer and a charge transport layer are prepared by repeating the procedure of Example 1, except that the ozone removing unit 20 in the air conditioning control unit 2 shown in FIG. 1 is not activated. Using the thus prepared coating solutions, electrophotographic photoreceptors are produced continuously and a total of 20 photoreceptor drums are randomly samples as in Example 1.

As it turned out, the concentration of oxidants in atmospheric air varied over the range 0 to 100 ppb but that in the solution preparing compartment 1 varied over the range 0 to 90 ppb.

Example 3

Coating solutions for forming a charge generation layer and a charge transport layer are prepared by repeating the procedure of Example 1, except that the ozone removing units 20 in the air conditioning control unit 2 connected to the air ducts 14, 15 and 16 shown in FIG. 2 are not activated. Using the thus prepared coating solutions, electrophotographic photoreceptors are produced continuously and a total of 20 photoreceptor drums are randomly sampled as in Example 1.

As it turned out, the concentration of oxidants in atmospheric air varied over the range 10 to 110 ppb but those in the coating compartments 9 and 11, as well as in the drying units 10 and 12 varied over the range 5 to 90 ppb.

Comparative Example 1

Coating solutions for forming a charge generation layer and a charge transport layer are prepared by repeating the procedure of Example 1, except that all of the ozone removing units 20 in the air conditioning control unit 2 are not activated. Using the thus prepared coating solutions, electrophotographic photoreceptors are produced continuously and a total of 20 photoreceptor drums are randomly sampled as in Example 1. In this case, the concentration of oxidants in atmospheric air varied over the range 0 to 100 ppb.

The samples photoreceptor drums are evaluated for their electrophotographic characteristics by an analyzer available from Fuji Xerox Co., Ltd.

Each sample is charged with a scorotron device with a voltage of −600 V being applied to the grid (step A); 0.5 sec later, exposure is done by illumination with light of 10.0 erg/$cm^2$ from a semiconductor layer ($\lambda$, 780 nm) (step B); another 0.4 sec later, erasure is done by flooding with a red LED. Potential measurements are conducted after steps (A) and (B) of this electrophotographic cycle. The results are shown in Table 1 below.

TABLE 1

| | Example 1 | Example 2 | Example 3 | Comparative Example 1 |
|---|---|---|---|---|
| Variations in oxidant conc., ppb | | | | |
| within solution preparing compartment | 0–15 | 0–90 | 0–15 | 0–90 |
| within coating compartments and drying units | 0–20 | 0–20 | 5–90 | 5–90 |

TABLE 1-continued

| | Example 1 | Example 2 | Example 3 | Comparative Example 1 |
|---|---|---|---|---|
| Potential (A), V | | | | |
| average for 20 samples | 593.5 | 588.4 | 575.4 | 574.1 |
| s.d. for 20 samples | 1.3 | 2.5 | 9.4 | 9.9. |
| Potential (B), V | | | | |
| average for 20 samples | 112.6 | 132.0 | 135.2 | 160.1 |
| s.d. for 20 samples | 2.2 | 2.8 | 8.1 | 14.7 |

As is clear from Table 1, the photoreceptor samples produced in Comparative Example 1 without activating any of the ozone removing units in the air conditioning control unit are characterized not only by lower charging potential and sensitivity but also by much greater standard deviation (s.d., or variations in characteristics) than the samples of Examples 1 to 3; obviously, the samples of Comparative Example 1 are affected by the concentration of oxidants in atmospheric air. Stated more specifically, in the absence of ozone removing units from the air conditioning control unit, the concentrations of oxidants within the solution preparing compartment, coating compartments and drying units are almost comparable to that in atmospheric air and any variations in the latter would affect the characteristics of photoreceptor being produced, thereby impairing their consistency.

In contrast, the photoreceptor drums produced in Example 1 had high potential (A) but low potential (B), indicating that they had high charging potential and good sensitivity. In addition, the standard deviations of both potentials are small enough to assure high consistency in characteristics. In Example 2 where the concentrations of oxidants within the coating compartments and the drying units are not only reduced but also allowed to experience variations over smaller ranges, photoreceptor drums with generally good characteristics are produced; the samples produced in Example 3 by reducing only the concentration of oxidants within the solution preparing compartment had a higher sensitivity than the samples produced in Comparative Example 1.

Comparing the results of Examples 2 and 3 as shown in Table 1, one can see that if the ozone removing unit is to be activated at all, it is more effective to lower the concentrations of oxidants within the coating compartments and the drying units, rather than in the solution preparing compartment, by sufficient degrees to reduce the range of their variations.

Example 4

Coating solutions for forming a light-sensitive layer are prepared by the following method within the same preparing compartment as used in Example 1 (see FIG. 1).

A hundred parts of a 50% toluene solution of tributoxyzirconium acetyl acetonate (ZC540, the trade name of Matsumoto Kosho K.K.), 11 parts of γ-aminopropyltrimethoxysilane (A1110, the trade name of Nippon Yunicar Co., Ltd.), 440 parts of i-propyl alcohol and 220 parts of n-butyl alcohol are mixed and agitated with a stirrer to prepare a coating solution for forming a subbing layer.

In a separate step, 5 parts of polyvinylbutyral (ES-lec BM-2, the trade name of Sekisui Chemical Co., Ltd.) are dissolved in 100 parts of cyclohexanone. To the resulting solution, 8 parts of a brominated anthanthrone pigment (C.I. Pigment Red 168) is added and dispersed with a sand mill for 8 h. Thereafter, the dispersion is diluted with cyclohexanone to prepare a coating solution for forming a charge generation layer that had a solids content of 9.0 wt %.

To prepare a coating solution for forming a charge transport layer, 5 parts of a charge transport material (1,1-bis(p-diethylaminophenyl)-4,4-diphenyl-1,3-butadiene) is dissolved in 40 parts of methylene chloride together with 5 parts of a polycarbonate Z resin.

Using the thus prepared coating solutions, electrophotographic photoreceptors are produced by the following method on bases that are in the form of aluminum pipes (84 $mm^{\Phi}$×310 $mm^{L}$) .

The production equipment used is the same as what is adopted in Example 1, except that a subbing layer coating compartment and its drying unit having the same constructions as the charge generation layer coating compartment 9 (see FIG. 2) and its drying unit 10, respectively, are provided between the base entrance 8 and the coating compartment 9. The subbing layer coating compartment is equipped with a dip coating device; each of the subbing layer coating compartment and its drying unit is supplied with conditioned air that had its ozone concentration suppressed to below a specified level by ozone removing unit 20 that used the same ozone filter as employed in Example 1.

First, the aluminum pipes are coated with the coating solution for forming a subbing layer within the subbing layer coating compartment; the applied coating is dried in the subbing layer drying unit by heating for 10 min with the conditioned air that had been heated to 175° C.; as a result, a subbing layer is formed in a thickness of 0.1 μm. Subsequently, the subbing layer is coated with the coating solution for forming a charge generation layer within the coating compartment 9; the applied coating is dried in the drying unit 10 by heating for 10 min with the conditioned air that had been heated to 100° C.; as a result, a charge generation layer is formed in a thickness of 1.0 μm. The charge generation layer, in turn, is coated with the coating solution for forming a charge transport layer within the coating compartment 11; the applied coating is dried in the drying unit 12 by heating for 60 min with the conditioned air that had been heated to 100° C.; as a result, a charge transport layer is formed in a thickness of 20 μm.

The production of photoreceptors by the coating and drying steps described above is continued while, as in Example 1, the concentrations of oxidants in atmospheric air, in coating compartments 9 and 11, as well as in drying units 10 and 12 are kept monitored.

A total of 20 photoreceptor drums are sampled randomly from the photoreceptors produced in the manner described above.

Example 5

Coating solutions for forming a subbing layer, a charge generation layer and a charge transport layer are prepared by repeating the procedure of Example 4, except that the ozone removing unit 20 in the air conditioning control unit 2 shown in FIG. 1 is not activated. Using the thus prepared coating solutions, electrophotographic photoreceptors are produced continuously and a total of 20 photoreceptor drums are sampled as in Example 4.

Example 6

Coating solutions for forming a subbing layer, a charge generation layer and a charge transport layer are prepared by repeating the procedure of Example 4, except that the ozone removing units 20 in the air conditioning control unit 2 connected to the air ducts 14, 15 and 16 shown in FIG. 2 are not activated. Using the thus prepared coating solutions, electrophotographic photoreceptors are produced continuously and a total of 20 photoreceptor drums are randomly sampled as in Example 4.

Comparative Example 2

Coating solutions for forming a subbing layer, a charge generation layer and a charge transport layer are prepared by repeating the procedure of Example 4, except that the ozone removing units 20 in the air conditioning control unit 2 are not activated. Using the thus prepared coating solutions, electrophotographic photoreceptors are produced continuously and a total of 20 photoreceptor drums are randomly sampled as in Example 4.

The sampled photoreceptor drums are evaluated for their electrophotographic characteristics by the same analyzer as used in Example 1 that are available from Fuji Xerox Co., Ltd.

Each sample is subjected to the following cycle of electrophotographic steps it is charged with a corotron device with a voltage of −5.5 kV being applied (step A); 0.7 sec later, exposure is done by illumination with white light of 9.0 erg/cm$^2$ (step B); another 1.0 sec later, erasure is done by flooding with green light of 50 erg/cm$^2$ (step C). Potential measurements are conducted after these three steps. The higher the potential (A), the better the chargeability of the photoreceptor under test; the lower the potential (B), the higher the sensitivity; and the lower the potential (C), the lower the residual potential.

The results are shown in Table 2.

TABLE 1

| | Example 4 | Example 5 | Example 6 | Comparative Example 2 |
|---|---|---|---|---|
| Variations in oxidant conc., ppb | | | | |
| within solution preparing compartment | 0–10 | 0–95 | 0–10 | 0–95 |
| within coating compartments and drying units | 0–25 | 0–25 | 0–90 | 0–90 |
| Potential (A), V | | | | |
| average for 20 samples | 802.4 | 800.4 | 798.6 | 789.9 |
| s.d. for 20 samples | 3.3 | 4.8 | 5.6 | 4.2 |
| Potential (B), V | | | | |
| average for 20 samples | 145.6 | 153.8 | 166.9 | 171.6 |
| s.d. for 20 samples | 3.3 | 4.8 | 8.0 | 17.7 |
| Potential (C), V | | | | |
| average for 20 samples | 23.0 | 24.9 | 28.8 | 28.5 |
| s.d. for 20 samples | 0.4 | 1.2 | 3.2 | 5.3 |

One can readily see that the data shown in Table 2 have substantially the same characteristics as the data shown in Table 1.

In accordance with the process of the present invention, electrophotographic photoreceptors having good consistent characteristics can be produced while avoiding the adverse effects of oxidants that occur during photoreceptor production in the coating solution preparing compartment, or the coating compartments of the associated drying units. It should particularly be noted that even if the production continues for an extended period, desired electrophotographic photoreceptors can be produced in a consistent manner and this is not only favorable for the purpose of insuring good quality but also instrumental to an improvement in yield, thereby reducing the production cost.

What is claimed is:

1. A process for producing an electrophotographic photoreceptor comprising the steps of:

removing part of or all oxidants from an air atmosphere to form a treated air atmosphere; and preparing a coating solution capable of forming a light-sensitive layer on an electroconductive base;

coating said coating solution on an electroconductive base; and drying said coating to form a light-sensitive layer;

wherein said step of coating is performed in said treated atmosphere.

2. The process according to claim 1 further comprising suppressing variation of the concentration of said oxidants.

3. The process according to claim 2, wherein the step of preparing said coating solution is performed in said treated air atmosphere.

4. The process according to claim 3, wherein the concentration of said oxidants is 80 ppb or below.

5. The process according to claim 2, wherein said step of drying said coating is performed in said treated air atmosphere.

6. The process according to claim 5, wherein the concentration of said oxidants is 50 ppb or below.

7. The process according to claim 1, wherein said step of coating is a dip coating process.

8. The process according to claim 1, wherein said step of drying is performed in said treated air atmosphere.

9. The process according to claim 8, wherein said step of coating is a dip coating process.

10. The process according to claim 8, wherein said step of preparing said coating solution is performed in said treated air atmosphere.

11. The process according to claim 10, wherein said step of coating is a dip coating process.

12. A process for producing an electrophotographic photoreceptor comprising the steps of:

removing part or all oxidants from an air atmosphere such that the concentration of oxidants is 80 ppb or less and suppressing variation of the concentration of oxidants in the air atmosphere to form a treated air atmosphere;

preparing a coating solution capable of forming a light-sensitive layer on an electroconductive base;

coating said coating solution on an electroconductive base; and drying said coating to form a light-sensitive layer;

wherein said step of coating is performed in said treated air atmosphere.

13. A process according to claim 12, wherein said concentration of oxidants is 50 ppb or below.

* * * * *